US007882670B2

(12) United States Patent
West

(10) Patent No.: US 7,882,670 B2
(45) Date of Patent: Feb. 8, 2011

(54) ROOF VENT BASE PLATE AND INSTALLATION METHODS

(76) Inventor: G. Leonard West, 19569 Hazel Nut Ave., Lakeville, MN (US) 55044

( * ) Notice: Subject to any disclaimer, the term of this patent is extended or adjusted under 35 U.S.C. 154(b) by 272 days.

(21) Appl. No.: 12/178,298

(22) Filed: Jul. 23, 2008

(65) Prior Publication Data

US 2009/0013620 A1 Jan. 15, 2009

Related U.S. Application Data

(63) Continuation-in-part of application No. 10/918,925, filed on Aug. 17, 2004, now abandoned.

(51) Int. Cl.
*E04C 1/00* (2006.01)

(52) U.S. Cl. ..... 52/309.4; 52/630; 454/13; 454/14; 454/366; 454/367

(58) Field of Classification Search ..... 52/309, 52/4, 630; 454/13, 14, 366, 367
See application file for complete search history.

(56) References Cited

U.S. PATENT DOCUMENTS

| | | | |
|---|---|---|---|
| 2,214,183 | A | 9/1940 | Seymour |
| 3,460,855 | A | 8/1969 | Belden |
| 3,593,478 | A | 7/1971 | Mason |
| 3,797,181 | A | 3/1974 | Nievelt |
| 3,934,383 | A | 1/1976 | Perry et al. |
| 3,938,429 | A | 2/1976 | Perry |
| 3,984,947 | A | 10/1976 | Patry |
| 4,333,660 | A | 6/1982 | Cupit |
| 4,386,488 | A | 6/1983 | Gibbs |
| 4,512,119 | A | 4/1985 | Willoughby |
| 4,570,396 | A | 2/1986 | Struben |
| 4,768,812 | A | 9/1988 | Katz |
| 4,899,505 | A | 2/1990 | Williamson et al. |
| 5,005,328 | A | 4/1991 | Holtgreve |
| 5,226,263 | A | 7/1993 | Merrin et al. |
| 5,339,582 | A | 8/1994 | Sells |
| 5,394,663 | A | 3/1995 | Jackson |
| 5,439,417 | A | 8/1995 | Sells |
| 5,472,241 | A | 12/1995 | Kosik, Jr. et al. |

(Continued)

OTHER PUBLICATIONS

Ortho's All About Roofing and Siding Basics, 2001, 1-53, Meredith Books, Des Moines, Iowa.

*Primary Examiner*—Richard E Chilcot, Jr.
*Assistant Examiner*—Mark R Wendell
(74) *Attorney, Agent, or Firm*—Moore & Hansen, PLLP

(57) ABSTRACT

A roof ventilation apparatus for a sloped roof having a cap and base plate is provided. The cap has a top surface and a bottom surface. The bottom surface has a flange that defines an opening to a cavity formed between the top and bottom cap surface. The cavity provides a path for air exchange from a roof opening through an air passage formed between the flange and cap top. The base plate has a collar or curb surrounding an aperture that fits inside the cap bottom cavity. The base plate preferably is shaped such that when installed on the sloped roof the cap entirely covers the base plate. Preferably, the base plate includes a collar and an angled edge configured to channel moisture that seeps within the vent cap.

8 Claims, 6 Drawing Sheets

U.S. PATENT DOCUMENTS

| | | | |
|---|---|---|---|
| 5,630,752 | A | 5/1997 | Gubash |
| 5,778,611 | A | 7/1998 | Michel |
| 5,860,256 | A | 1/1999 | Humber |
| 6,102,794 | A | 8/2000 | Cline |
| 6,185,885 | B1 | 2/2001 | Thaler |
| 6,202,372 | B1 | 3/2001 | Powell |
| 6,240,690 | B1 | 6/2001 | James et al. |
| 6,279,272 | B1 | 8/2001 | Nill, Jr. |
| 6,447,390 | B1 | 9/2002 | O'Hagin |
| 6,491,579 | B1 | 12/2002 | O'Hagin |
| 6,578,325 | B2 | 6/2003 | Henderson |
| 6,601,351 | B1 | 8/2003 | Zerfoss |
| 6,691,469 | B2 | 2/2004 | Miller |
| 6,733,381 | B1 | 5/2004 | Ploeger |
| 2001/0049261 | A1 | 12/2001 | McKee et al. |

ROOF VENT BASE PLATE AND INSTALLATION METHODS

RELATED APPLICATIONS

The present application is related to and claims priority to U.S. patent application Ser. No. 10/918,925, filed Aug. 17, 2004, currently pending, and is titled ROOF VENT AND METHOD OF INSTALLATION, wherein the aforementioned application is incorporated herein by reference.

FIELD OF THE INVENTION

The present invention is directed to a base plate that can be used in combination with roof vent caps such as covers, stack flashings, penetrations or the like. More specifically, the present invention is directed to a base plate that directs water away from a roof exhaust source. Even more particularly, the present invention relates to a base plate having an adhesive layer such that the base plate can be easily secured to a roof deck.

BACKGROUND OF THE RELATED ART

It is desirable to provide ventilation for the areas beneath building roofs to reduce the accumulation of heat and to reduce the accumulation of moisture in the attic or other spaces immediately below the roof, for example. In providing ventilation, it is important to prevent the entry of water into the building structure through the vent. Also, it is desirable to prevent debris and small animals from entering the building structure though the vent. Ultimately, the benefits of a properly constructed roof vent will prolong the life of the roof, virtually eliminate leaks caused by ice dams, reduce cooling bills, and reduce moisture build up in the attic that can lead to rot.

To protect buildings and their contents from water damage, roofers repair and install roofs made of tar, asphalt and gravel; rubber, thermoplastic; metal; or shingles made of asphalt, slate, fiberglass, wood, tile, or other material. There are two types of roofs—flat and sloped. Slope is the change in roof height for a horizontal distance for every 12 inches of horizontal distance (e.g., "flat slope" is about 0 to about 2 inch vertical distance for every 12 inches of horizontal distance and a "steep slope" is a greater than 2 inch vertical distance for every 12 inches of horizontal distance). Many commercial, industrial, and apartment buildings have flat or slightly sloping roofs for drainage (i.e., roofs with minimum slope of less than about 2 inches of vertical distance for every 12 inches of horizontal distance). Many residential houses have steep sloped roofs having a larger slope.

Flashings have been used for decades to weatherproof roof penetrations. Flashings protect the roof where moisture could get under it, such as at joints in the roof, places where a vent pipe or chimney pokes through, a valley where two roof surfaces meet, or where a roof meets a wall. Some flashings are installed before the roofing goes on, others are put in place along with the roofing. Flashing is widely used with shake, composite and wood shingles and roll roofing. Like many flashing pieces, the vent flashings are often "weaved" between shingle courses.

Flashings for pipes and other roof penetrations extending out of a roof exhaust source are often constructed from thin sheet metal that is cut and formed into the desired shape. The flashing is often formed from one piece of sheet material that has a central opening cut therein to fit about the roof penetration. Thereafter, a sealing material, such as caulk or tar, is applied proximate the juncture of the roof penetration and the central opening in the sheet material.

Roof vents (or turbine vents) come in many forms, but generally include some type of weather-shedding hood and a flange around the base that forms a seal between the vent and the surrounding roofing material. Some vents have a pipe that penetrates the roof surface and is exposed above the roof. Also, some vents have a tubular outside vent stack cover which is secured to a substantially flat roof flashing base plate. See, for example, U.S. Pat. No. 5,778,611 to Michel, "Vent Extension Flashing Assembly", issued Jul. 14, 1998. In other roof vents, the pipe remains exposed through the base plate flashing assembly. See for example U.S. Pat. No. 4,333,660 to Cupit, "Seal Device for Pipe Projecting through Roof", issued Jun. 8, 1982. Ultimately, to make a roof vent installation watertight, the most common technique is to "weave" or cover the vent flanges with roof material on the high side towards the roof ridge and along the edges of the vent, and cover the roofing material with the vent flange on the low side.

Known roof vents are typically assembled from essentially planar sheet material so that a portion of the sheet material about the central opening lies in approximately the same plane as the remaining portion of the sheet material. Such construction can lead to an increased likelihood of leakage at the central opening. An example of such a roof vent is disclosed in U.S. Pat. No. 4,570,396 to Struben, "Roof structure for mobile homes", issued Feb. 18, 1986.

The present invention addresses problems and limitations associated with the related art.

SUMMARY OF THE INVENTION

Preferred embodiments include a base plate that can be used in conjunction with a vent cap such as a cover, stack flashing, penetration or the like. The preferred base plate includes a substantially planar attachment portion and an aperture located within the attachment portion. The base plate further includes a collar or curb circumscribing the aperture; wherein the collar preferably defines a cylindrical channel. In further preferred embodiments the cylindrical channel is of a generally uniform diameter and the collar extends perpendicularly from the substantially planar attachment portion. Preferably, the collar extends upwardly when the attachment portion is operatively installed around the roof exhaust source. The preferred base plate substantially prevents any water that enters the vent cap from getting into the roof exhaust source, by diverting water away from the roof exhaust source, thus preventing leaks and resultant property damage.

The base plate is preferably used in conjunction with a vent cap. One potential vent cap has a top surface and a bottom surface. The top surface is configured to cover at least a portion of the roof exhaust source. The bottom surface has a flange that defines an opening to a cavity formed between the top and bottom cap surface. The flange extends outward relative to the cavity. The cavity is configured to provide a path for air exchange from the roof exhaust source through an air passage formed between the flange and the cap top. Preferably, the collar of the base plate is shaped such that the collar fits inside the cap bottom cavity. The base plate preferably is configured such that, when installed on the roof, the cap entirely covers the base plate. Alternatively, embodiments include a base plate with a planar attachment surface having an angled edge configured to channel moisture.

The preferred base plate includes an adhesive layer on a bottom surface of the generally planar attachment portion. The adhesive layer may cover a portion, most of or all of the bottom surface. The adhesive layer is preferably configured such that the base plate can be secured to the roof deck or underlayment with the adhesive. Suitable adhesives include, but are not limited to, rubberized asphalt adhesive, modified bitumen adhesives, acrylic or latex sealants or the like. In further preferred embodiments, the adhesive layer has a removable protective sheet such that the adhesive is covered until installation. This is highly preferred as it will make installation fast and easy as no separate tubes of adhesive or caulk will need to be carried or applied by the installer. In addition, this method is much less messy as there is nothing to drip or smudge. The installer can simply peel off the adhesive layer and press the adhesive onto the roof deck or underlayment.

The present invention further includes methods of installing a roof ventilation apparatus on a sloped roof having an opening therethrough, the method comprising steps of mounting a base plate to a sloped roof deck, securing a roof vent cap over the collar of the base plate and finally fitting roofing material courses over the substantially planar attachment portion in a manner such that only the vent cap is exposed when the roof ventilation apparatus is installed.

Additional advantages and features of the invention will be set forth in part in the description which follows, and in part, will become apparent to those skilled in the art upon examination of the following or may be learned by practice of the invention.

DETAILED DESCRIPTION OF THE PREFERRED EMBODIMENTS

The amount of water intrusion into our homes and businesses are at almost epidemic levels. Roof leaks have always been at the top of the list for a cause of water intrusion. A good roof system requires quality materials and detailed installation. Most roof leaks occur at the penetrations or vent caps in the roof. These penetrations being attic vents, plumbing vents, vent stacks for furnaces and fireplaces, bathroom vents and the like.

There are many different methods used when installing a roof-top vent caps. Sealants (e.g. tar, caulking and the like) and mastics (e.g. ice and water shield) are the practiced method used to make vent openings or roof exhaust sources leak-proof. The inventor has found that the use of sealants and mastics can be messy and can actually damage the roof system if not properly used. Moreover, these sealants and mastics can be subject to UV degradation. Expansion and contraction from weather extremes can further damage their effectiveness in preventing leaks.

The preferred base plate, as further discussed below, provides a second layer of protection from roof leaks that occur at roof exhaust sources. The base plate is preferably installed under the roof covering and is not "weaved in" with the roof covering. The inventor has found that the weaving process can result in leaks. The base plate creates a "curb" at the roof exhaust source which will generally stop any liquid that may leak through the vent installation from entering the roof exhaust source.

Figure 1:
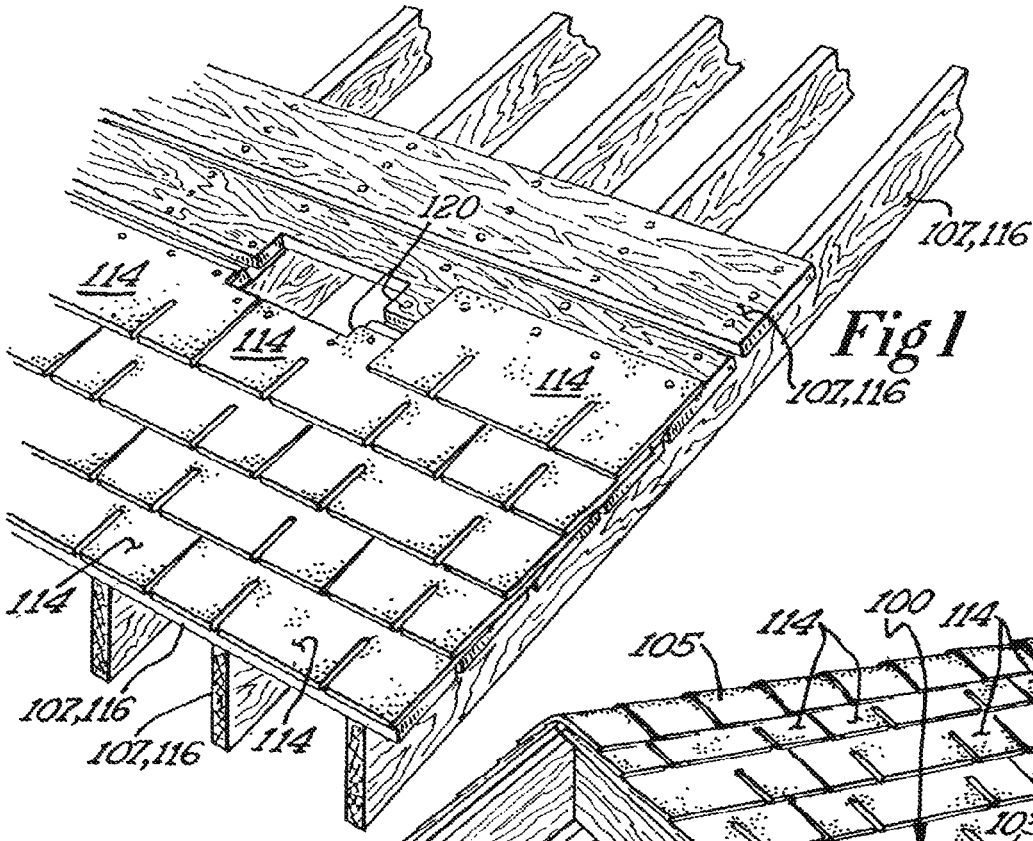
FIG. 1 is a perspective view of a roof ventilation apparatus installed on a roof with a portion of roof sheathing of the roof exposed.
Figure 2:
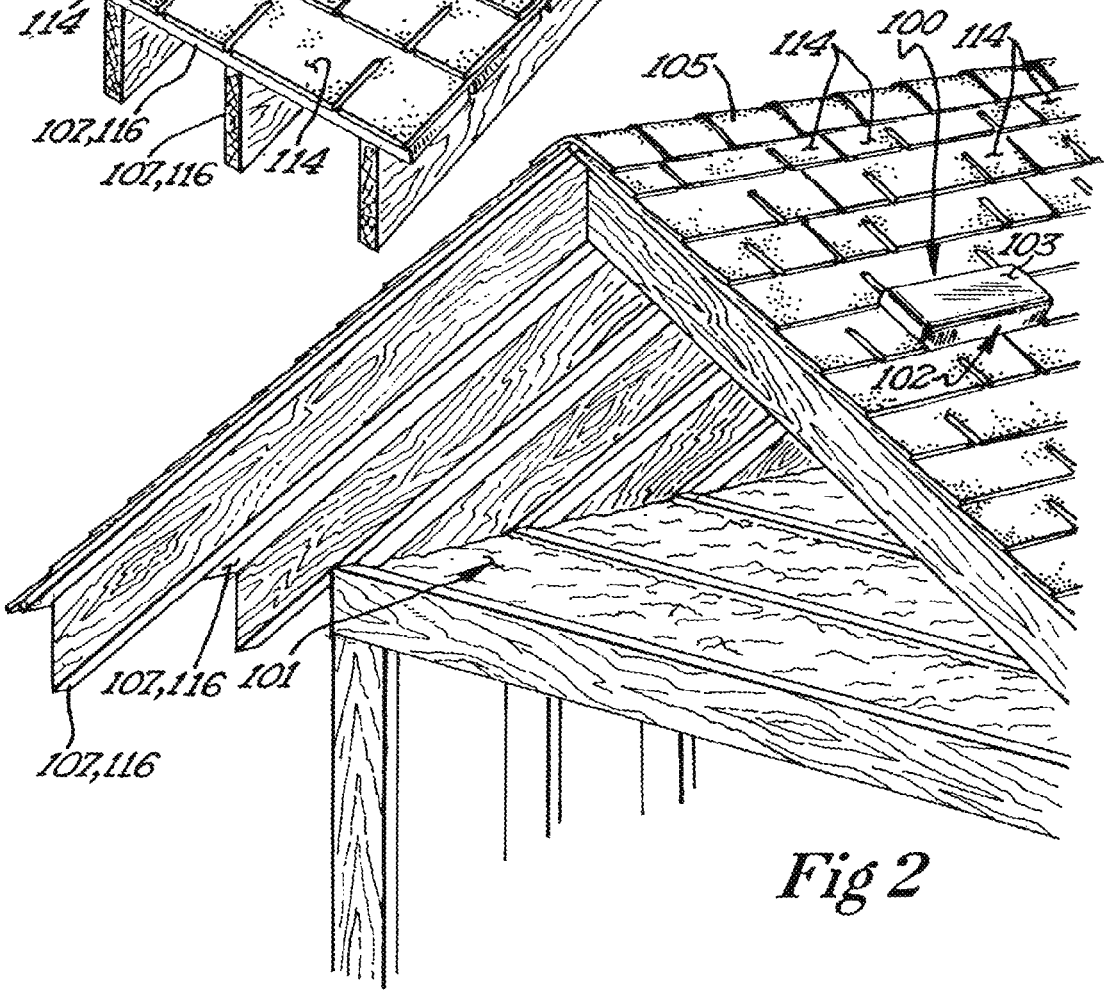
FIG. 2 is a perspective view of a roof ventilation apparatus installed on a sloped roof and revealing the attic underneath the sloped roof.

Preferred embodiments are illustrated in FIGS. 1-8. FIGS. 1-4 are a series of views illustrating a roof ventilation apparatus 100 that can be secured on sloped roofs for preventing leakage of a roof exhaust source such as a plumbing, attic or furnace vent. The preferred roof ventilation apparatus includes a vent cap 102 and a base plate 201. The inventor has found that the present invention is particularly beneficial when the slope of the roof, is greater than about 2 inches of vertical distance for every 12 inches of horizontal distance. FIG. 1 illustrates a roof including shingles 114 secured to a roof sheathing 107. In FIG. 2, the roof ventilation apparatus 100 is illustrated as being installed on a shingle roof to ventilate an attic 101. It will be appreciated by those skilled in the art that the base plate 201 can be used in conjunction with almost any kind of roof vent opening or exhaust source such as pluming vents, furnace vents or the like. It will be understood that, shakes, tiles, and other roofing materials can be used in alternative of shingles 114. FIG. 2 also illustrates a ridge 105 and roof deck 116.

Figure 3:
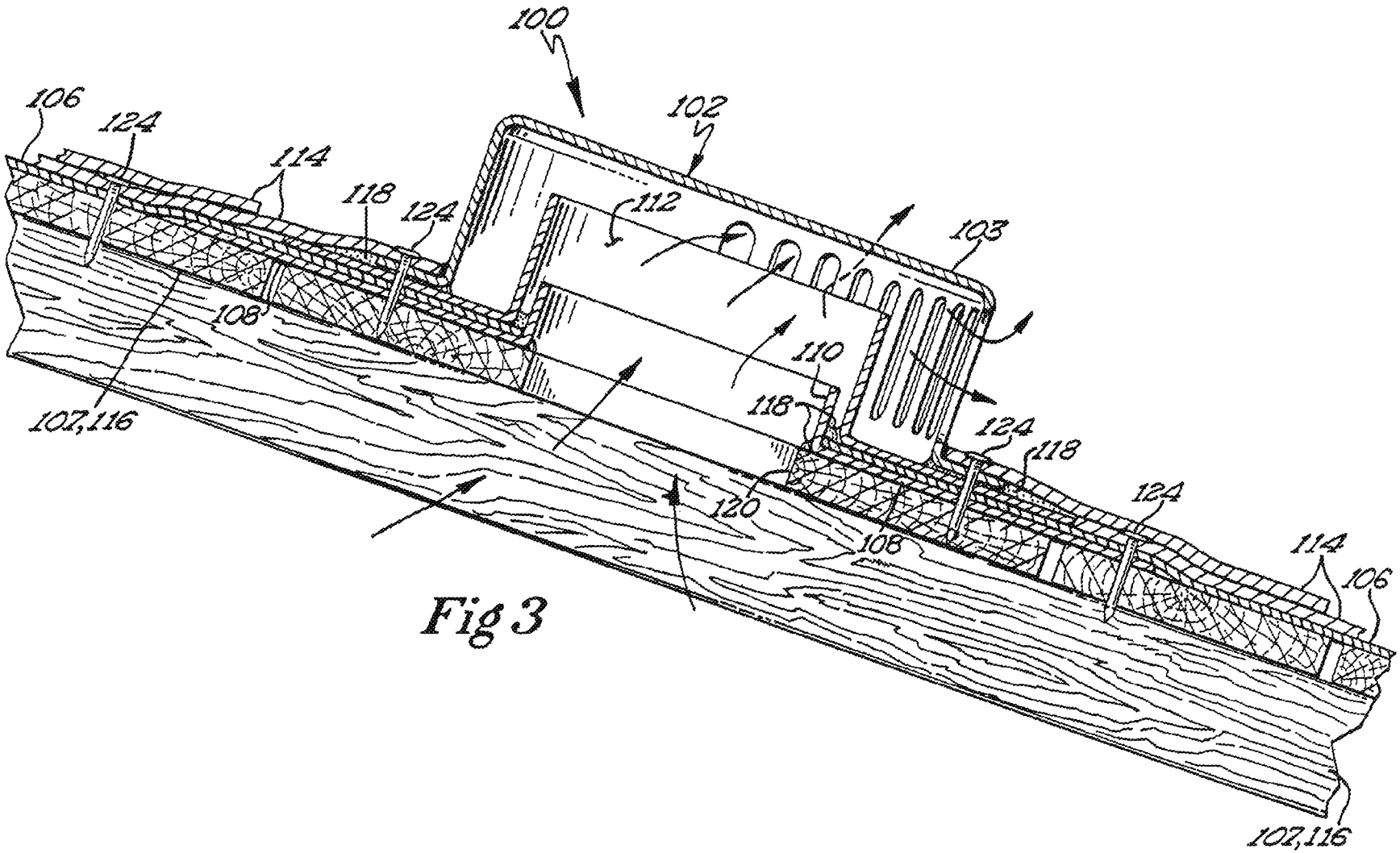
FIG. 3 is a cross-sectioned view of a roof ventilation apparatus.
Figure 4:
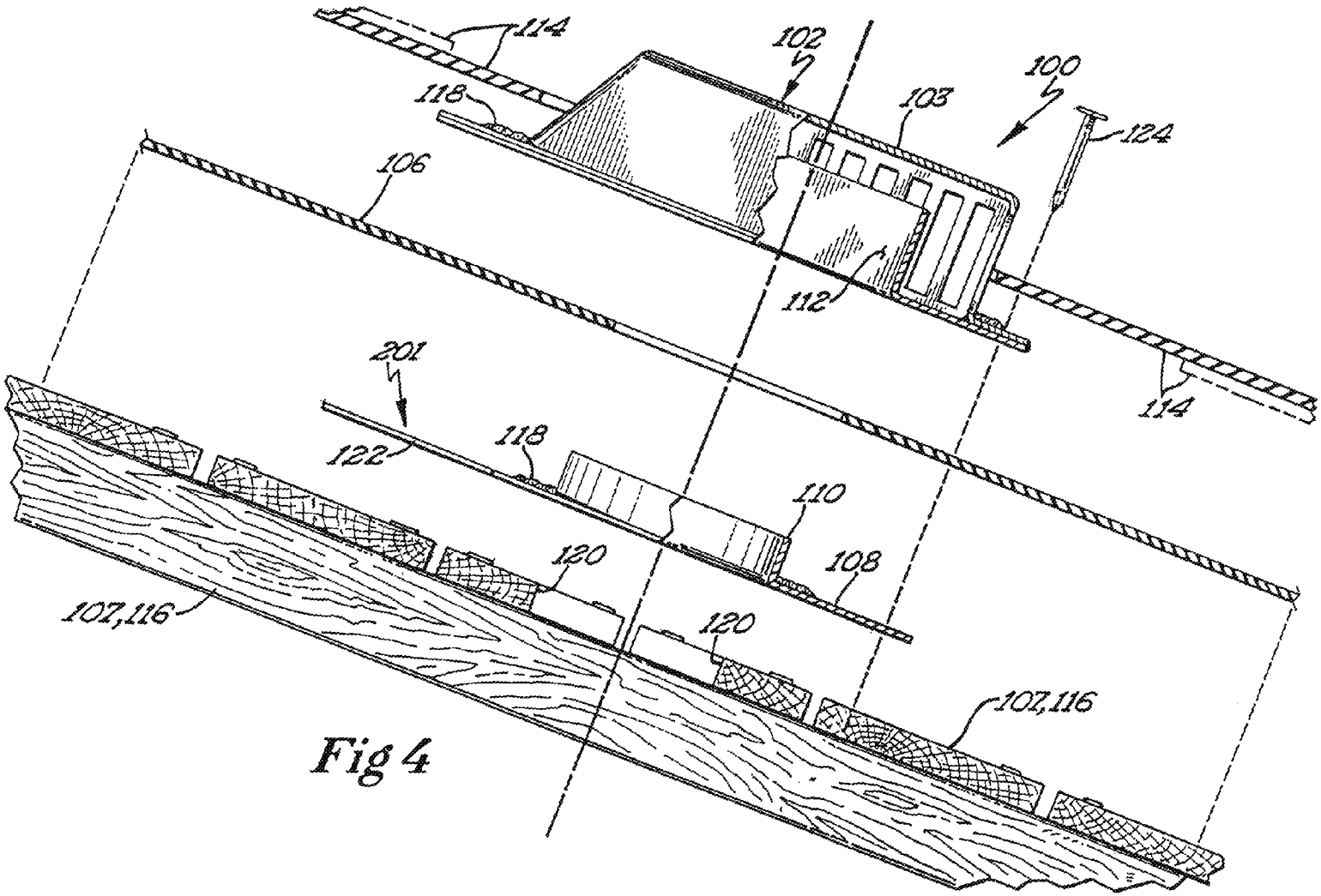
FIG. 4 is an exploded, partially cutaway view of a roof ventilation apparatus.

FIG. 3 is a cross-sectioned view illustrating one roof ventilation apparatus 100 having the vent cap 102 secured over a planar attachment portion 108 of the base plate 201. Now also referring to FIG. 4 showing an exploded, partially cutaway view of the roof ventilation apparatus 100 with the same parts shown in FIG. 3. The substantially planar attachment portion 108 of the base plate 201 is positioned on roof deck 116 having a roof exhaust source 120. The base plate 201 is positioned such that a collar or curb 110 circumscribing an aperture in the base plate is extending outwardly and generally perpendicularly from the roof deck 116. Preferably, however, the base plate 201 is secured over the roofing paper or alternative underlayment 106 with nails 124, screws, adhesives or the like. The roof exhaust source 120 can be any regular or irregular shape. Roofing paper 106 or the like can be secured over the substantially planar attachment portion 108. In the alternative, asphalt—impregnated felt or other underlayments can be used in conjunction with or substituted for roofing paper 106. In various embodiments, caulk bead 118 can be used to seal roofing paper 106 over the substantially planar attachment portion 108 and the base plate collar 110. It will be appreciated by those skilled in the art that the caulk bead 118 may be omitted or other forms of adhesive may be used instead of caulk bead 118. In various embodiments, the vent cap 102 is then fitted over the base plate 201 such that vent cavity 112 encircles base plate rim or collar 110. Vent cavity 112 and the base plate collar 110 can be formed in a wide variety of shapes. In preferred embodiments, base plate collar 110 has a uniform diameter (e.g. 8 inches) that is smaller than the cap bottom surface cavity 112 (e.g. having a largest planar dimension of 8 ½ inches) so that the collar nests within the bottom surface cavity 112. It will be appreciated by those skilled in the art that vent cap 102 can be either loosely or tightly fitted around base plate 201. In preferred embodiments, the bottom surface flange 104 entirely covers the base plate 201 after installation. Shingles 114 can then installed over cap bottom surface flange 104. Moisture is not likely to enter the roof exhaust source 120 because bottom surface flange 104 entirely covers base plate 108 over roofing paper 106. In addition, the collar 110 of the base plate 201 redirects moisture contacting the collar 110 away from the roof exhaust source 120. Preferably, only the vent cap top 103 is visible on the roof after installation of the roof ventilation apparatus 100.

Figure 5:
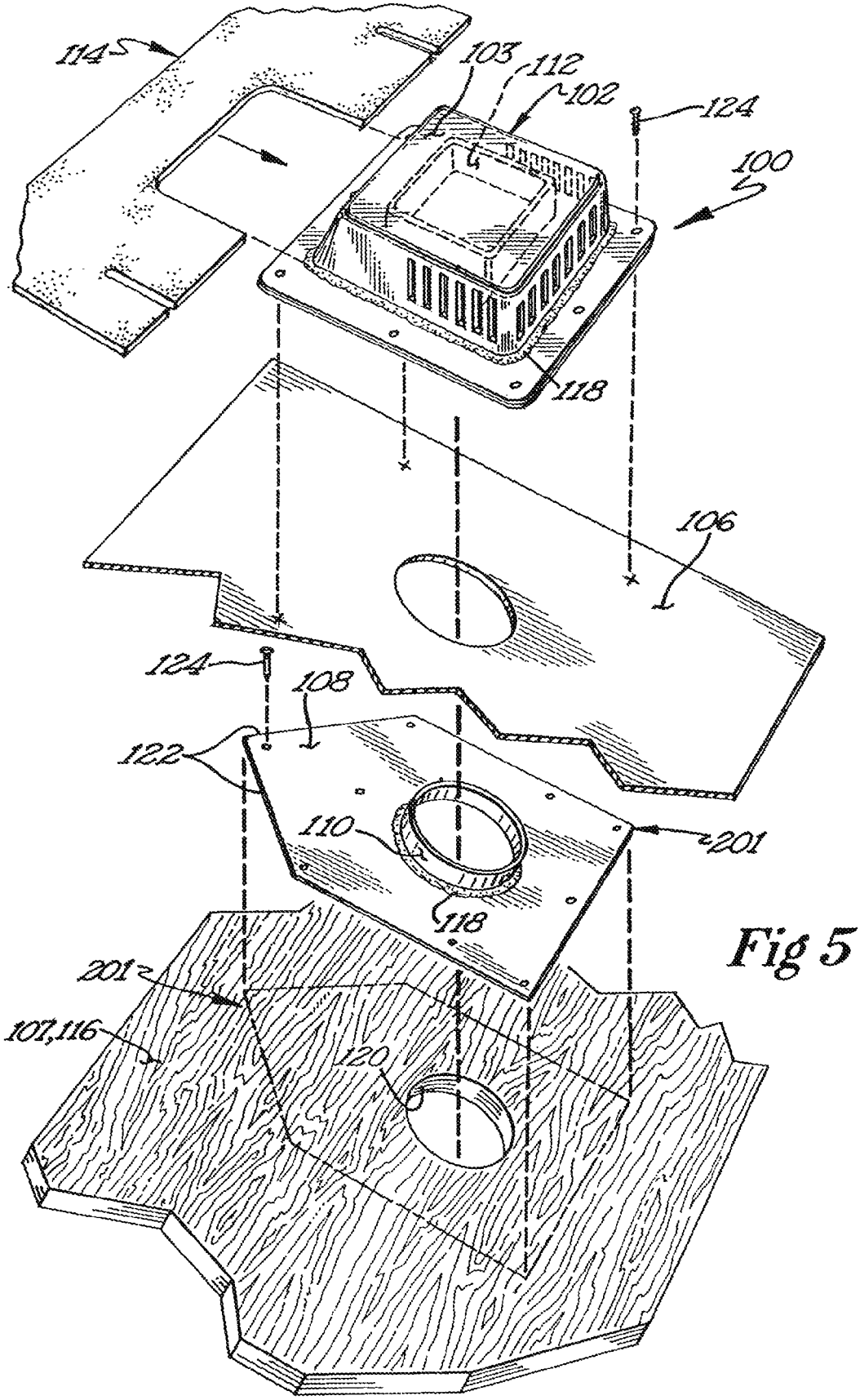
FIG. 5 is an exploded view of a roof ventilation apparatus.

FIG. 5 is an exploded view of the roof ventilation apparatus 100. FIG. 5 shows the base plate 201 being installed on a roof deck 116. It will be appreciated by those skilled in the art that the base plate 201 can be installed on any type of roof deck and roof sheathing, such as plywood. Moreover, the base plate 201 can be secured over the underlayment or roofing paper 106. The preferred base plate is constructed from a twenty to twenty-five gauge galvanized steel, for example. This material is preferred due to its lighter weight and manageability as compared to heavier gauge steel. Other alternative materials can be used for constructing the base plate, such as aluminum, copper, urethanes, and polymers. However, it will be appreciated by those skilled in the art that galvanized metal is preferred over polymers because it is believed, but not relied upon, that polymers tend to crack and curl with changing weather and are less weather resistant than metal.

Figure 6:
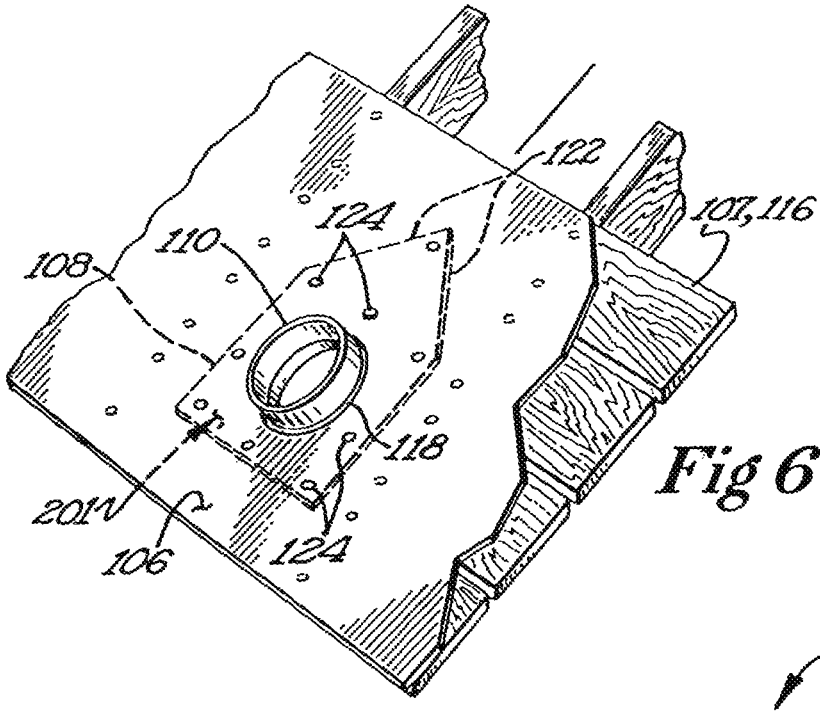
FIG. 6 is a perspective view of a base plate secured on a roof deck.
Figure 7:
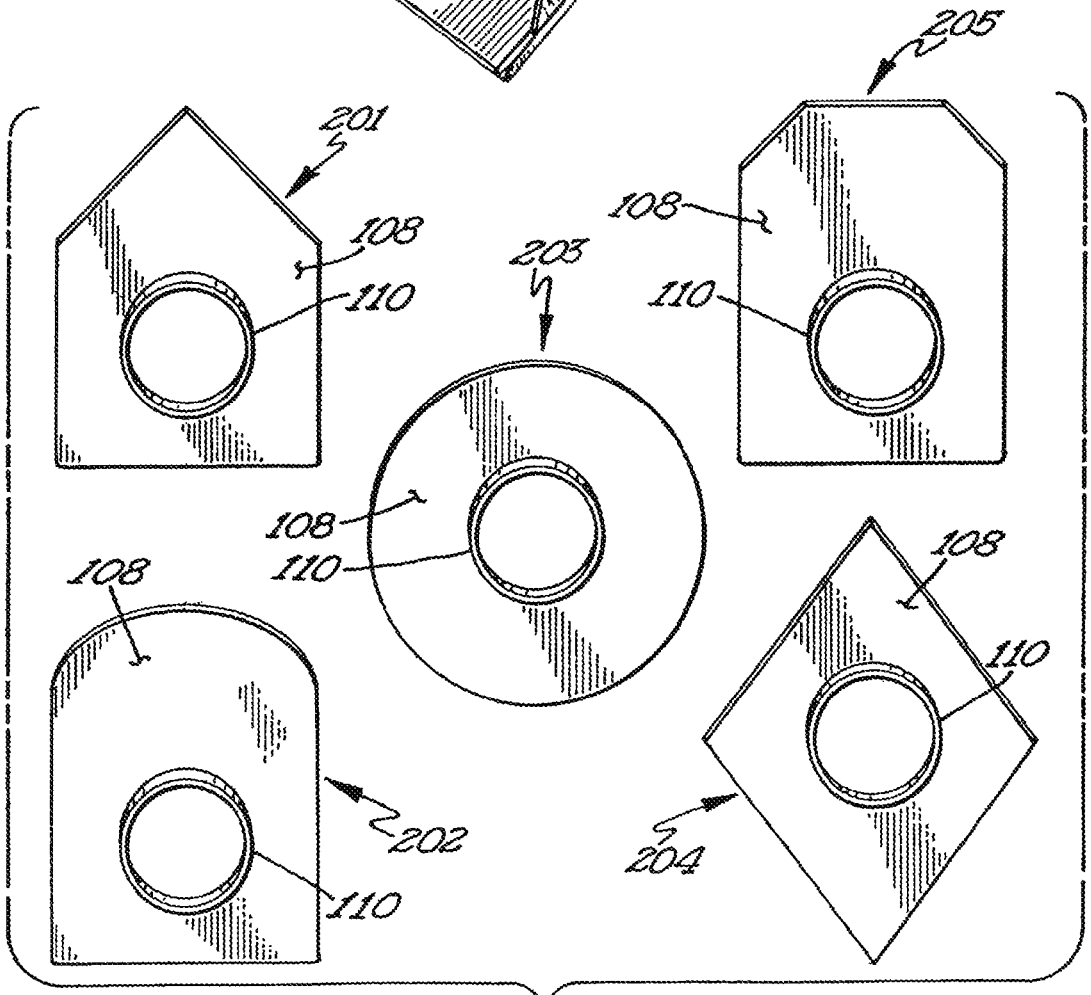
FIG. 7 illustrates alternative embodiment shapes of planar attachment portions of the base plate.

Referring also now to FIG. 6 that illustrates the substantially planar attachment portion 108 covered by the roofing paper 106. FIG. 6 additionally illustrates the roof deck 116 located underneath both the base plate 201 and roofing paper 106. FIG. 7 illustrates some possible alternative base plates 201, 202, 203, 204, 205 having different substantially planar attachment portions 108. Alternatively configured substantially planar attachment portions 108 of base plates 201 and 204 include peaked corners 122 that angle moisture away from the rim or collar 110. Another alternative substantially planar portion (not shown) could have a peaked corner off center or even moved to one corner such that the angle goes from a peak at one corner to a low point at another corner. Alternative planar attachment portion 108 of a base plate 205 has dubbed corners that channel moisture down the sides of the substantially planar attachment portion 108 away from base plate rim or collar 110. When installed, both the peaked and dubbed corners preferably point towards the high side of the roof (i.e., towards the roof ridge 105) and prevent the entry of moisture into the roof opening. Alternative embodiment base plates 202 and 203 illustrate alternative shapes of the attachment portion 108 that channel moisture away from the base plate collar 110 along a curved edge but otherwise similar to the mechanism provided for in the peaked and dubbed corners of alternative planar attachment portions of base plates 201, 204, and 205.

Figure 8:
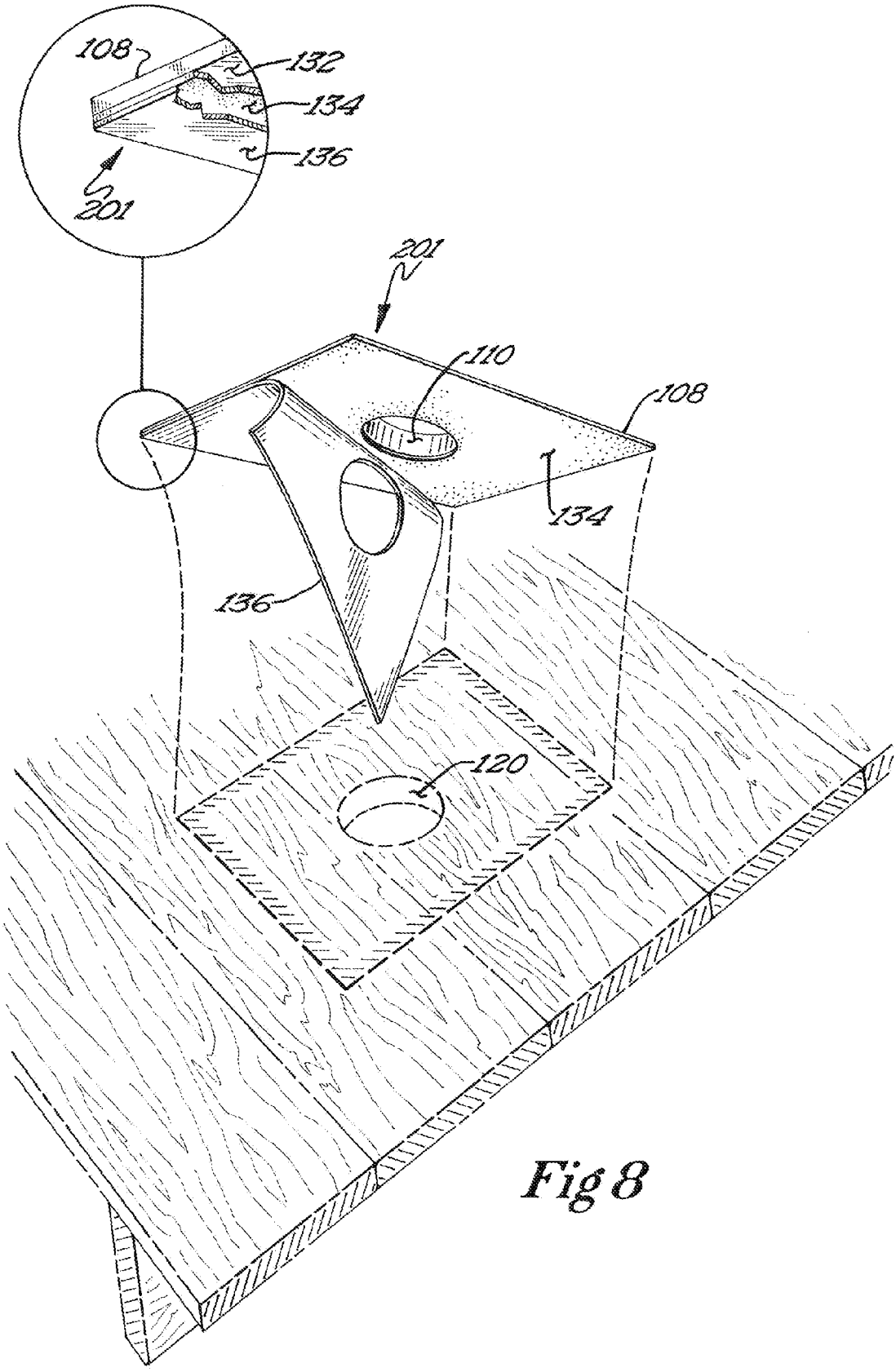
FIG. 8 is an alternate base plate having an adhesive layer.

Yet another preferred embodiment is illustrated in FIG. 8. FIG. 8 illustrates a base plate 206 that includes an adhesive layer 134, preferably a rubberized asphalt adhesive or the like, applied to the bottom surface 132 of the planar attachment portion 130. This will enable the base plate 206 to adhere and bond to the roof deck 107 (or alternatively, underlayment or the like 106). In addition, the adhesive layer 134 will help insure complete adhesion at the roof exhaust source 120 and eliminate the use of messy tar, caulk or mastics. The adhesive layer 134 will not be exposed to UV degradation. This will insure adhesion through any expansion or contraction that may occur. Installers previously have had to depend on sealants or mastics which are liquid penetrable.

In preferred embodiments, the adhesive layer 134 is of the type as to additionally create a generally leak-proof ice and water barrier at the bottom surface 132 of the planar attachment portion 130. Examples of such an adhesive are rubberized asphalt adhesive, modified bitumen, acrylic or latex sealants or the like. It will be understood that the adhesive layer 134 need not cover the entire bottom surface 132.

A release paper or protective sheet 136 is preferably applied over the adhesive layer 134 to protect the adhesive layer until the time for installation. At the time of installation, the release paper 136 can be easily peeled or otherwise removed to expose the adhesive layer 134.

Preferred embodiments include the adhesive layer and protective sheet to make installation fast and easy as no separate tubes of adhesive or caulk will need to be carried or applied by the installer. In addition, this method is much less messy as there is nothing to drip or smudge. The installer can simply peel off the adhesive layer and press the adhesive onto the roof deck or underlayment at the time of installation.

The present invention further includes methods of installing a base plate 201, 202, 203, 204, 205 for preventing vent cap 102 leaks from entering into a roof exhaust source. The preferred method includes the steps of providing a roof deck 107, 116 having a roof exhaust source 120. Additionally, a base plate 201,202, 203, 204, 205 is provided. The preferred base plate having a substantially planar attachment portion 108 and an aperture located within the substantially planar attachment portion and a collar 110 circumscribing the aperture. The base plate is then secured to the roof deck, preferably, by removing the protectant sheet 136 to expose the adhesive layer 134. The base plate can then be pressed onto the roof deck, or alternatively, underlayment 106. If the base plate does not include an adhesive layer, adhesive or caulk can be applied to secure and seal the base plate to the roof deck. The base plate is positioned such that the aperture of the base plate surrounds the roof exhaust source and the collar extends upward therefrom. The next preferred step is to secure roofing materials 114 over at least a portion of the substantially planar attachment portion and then to fit the vent cap over the base plate. Next, preferably roofing materials are secured over at least a portion of the vent cap.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed.

What is claimed is:

1. A roof ventilation apparatus for installation on a sloped roof having a roof exhaust source therethrough, the roof ventilation apparatus comprising:

a base plate including:

a substantially planar attachment portion; and an aperture located within the attachment portion;

the base plate further having a collar circumscribing the aperture;

the collar defining a cylindrical channel;

the cylindrical channel having a generally uniform diameter;

the collar extending perpendicularly from the substantially planar attachment portion;

the collar extending upwardly from the sloped roof when the base plate is operatively installed around the roof exhaust source;

a vent cap having a dome and a mounting flange;

the dome including a water shedding cover and further including side walls extending downwardly from the water shedding cover, the side walls including at least one ventilation port; and the mounting flange being attached to and extending outwardly from the side walls of the dome and arranged and configured to entirely cover the base plate when the vent cap is installed on the roof;

wherein the vent cap and the base plate cooperate to permit air moving upward from the roof exhaust source and through the collar to exit the vent cap through the at least one ventilation port;

wherein the collar intercepting any water which reaches the base plate through the at least one ventilation port.

2. The roof ventilation apparatus of claim 1, wherein the collar has an upper edge that terminates below the dome leaving a space between the upper edge of the collar and the vent cap through which air can flow.

3. The roof ventilation apparatus of claim 1, the planar attachment portion having at least one angled edge, the at least one angled edge having peaked corners configured and arranged to be oriented towards a roof ridge.

4. The roof ventilation apparatus of claim 1, the planar attachment portion having at least one angled edge, the at least one angled edge having a curved edge configured and arranged to be oriented towards a roof ridge.

5. The roof ventilation apparatus of claim 1, the substantially planar attachment plate including a bottom surface, the bottom surface having an adhesive layer.

6. The roof ventilation apparatus of claim 5, wherein the adhesive layer includes a removable protectant sheet.

7. The roof ventilation apparatus of claim 5, wherein the adhesive layer substantially covers the entire bottom surface.

8. The roof ventilation apparatus of claim 1, the planar attachment portion being generally rectangular in shape and having a generally uniform thickness.

* * * * *